United States Patent [19]

Yamada et al.

[11] Patent Number: 4,882,248

[45] Date of Patent: Nov. 21, 1989

[54] ELECTROPHOTOGRAPHIC PLATE FOR MAKING PRINTING PLATE COMPRISING PHTHALOCYANINE PIGMENT AND THIOBARBITURIC ACID RESIDUE CONTAINING COMPOUND

[75] Inventors: Jun Yamada; Hiromi Eguchi, both of Nagaokakyo, Japan

[73] Assignee: Mitsubishi Paper Mills, Ltd., Tokyo, Japan

[21] Appl. No.: 167,954

[22] Filed: Mar. 14, 1988

[30] Foreign Application Priority Data

Mar. 16, 1987 [JP] Japan ..... 62-61483

[51] Int. Cl.[4] ..... G03G 13/26

[52] U.S. Cl. ..... 430/49; 430/56; 430/76; 430/83

[58] Field of Search ..... 430/49, 76, 56, 83

[56] References Cited

U.S. PATENT DOCUMENTS

| | | | |
|---|---|---|---|
| 4,395,473 | 7/1983 | Horie et al. | 430/76 X |
| 4,450,219 | 5/1984 | Horie et al. | 430/77 X |
| 4,476,208 | 10/1984 | Horie et al. | 430/78 X |
| 4,500,622 | 2/1985 | Horie et al. | 430/76 X |

*Primary Examiner*—J. David Welsh

*Attorney, Agent, or Firm*—Cushman, Darby & Cushman

[57] ABSTRACT

An electrophotographic plate for making a printing plate is provided. Said electrophotographic plate comprises an electrically conductive and hydrophilic base and a photoconductive layer provided thereon, said photoconductive layer containing an alkali and/or alcohol soluble polymer, a phtalocyanine pigment and a compound represented by the formula (I):

$$(X)_nY \qquad (I)$$

where X represents thiobarbituric acid residue from which one hydrogen atom at 5-position has been eliminated and in which nitrogen atom in a ring may have a substituent; Y represents an n-valent substituted or unsubstituted alkylene or aralkylene residue; and n represents an integer of 2 to 4. This plate has high sensitivity and resolving power and from this plate a printing plate of high printing endurance and low printing strain can be made.

13 Claims, 1 Drawing Sheet

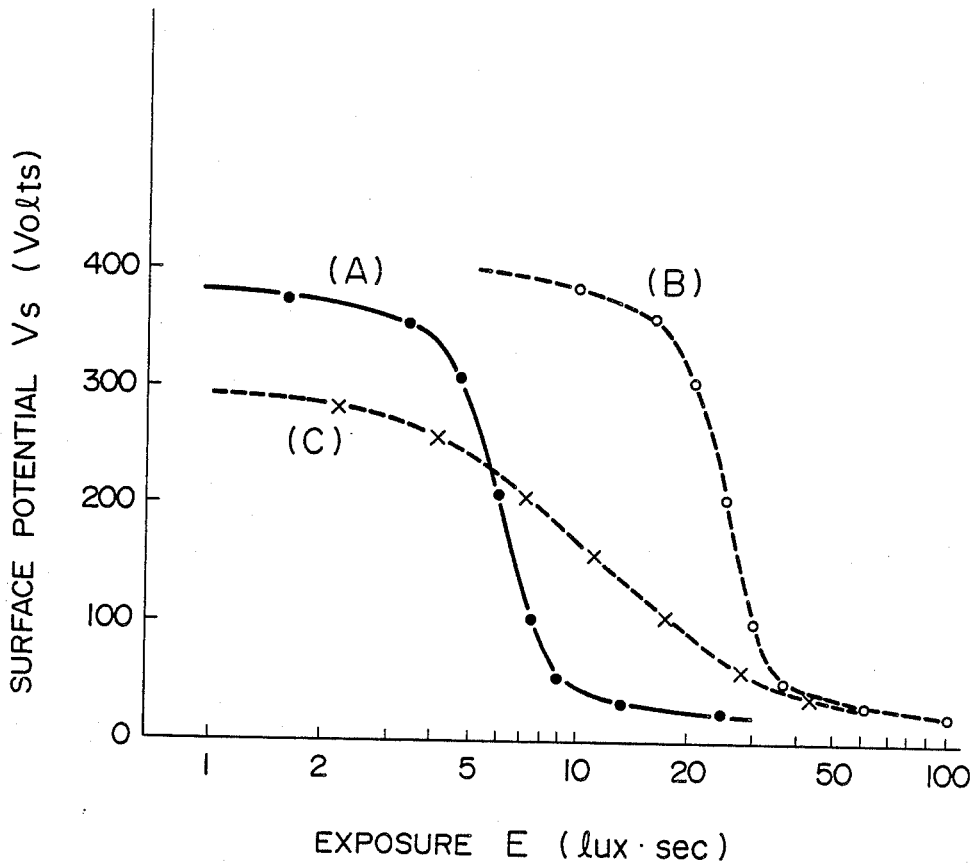
SURFACE POTENTIAL Vs (Volts)
400
300
200
100
0
(A)
(B)
(C)
1
2
5
10
20
50
100
EXPOSURE E (lux · sec)

ELECTROPHOTOGRAPHIC PLATE FOR MAKING PRINTING PLATE COMPRISING PHTHALOCYANINE PIGMENT AND THIOBARBITURIC ACID RESIDUE CONTAINING COMPOUND

BACKGROUND OF THE INVENTION

The present invention relates to an electrophotographic plate for lithographic printing and a lithographic printing plate made therefrom.

Hitherto, as printing plates for lithographic printing, there have been known those which use light sensitive resins and silver halide light sensitive materials. The former are superior in resolution and printing endurance, but low in sensitivity and the latter are high in sensitivity and resolution, but expensive and inferior in printing endurance.

Lithographic printing plates of electrophotographic type which use photoconductive materials are relatively high in sensitivity and can provide inexpensive, high endurance plates and recently have been studied intensively. Printing plates of this type are made by forming toner images on a photoconductive layer provided on a support by an electrophotographic method and then rendering the non-image area hydrophilic or dissolving out the non-image area. For example, in the case of printing plates comprising a support and, provided thereon, a photoconductive layer comprising a binder, zinc oxide as a photoconductive material and a sensitizer, the non-image area is rendered hydrophilic by, for example, potassium ferrocyanide to produce printing plates. However, hydrophilicity of the non-image area is inferior and hence the plates are easily stained and, further, are low in printing endurance. There is another printing plate having a hydrophilic aluminum plate as a support and the non-image area is dissolved out, but the photoconductive layer contains zinc oxide in a large amount and so dissolving out of the non-image area is difficult and the surface of the hydrophilic aluminum plate cannot be sufficiently utilized. An example of using an organic photoconductor as a photoconductive material is disclosed in Japanese Patent Unexamined Publication (Kokai) No. 107246/81, a photoconductive layer comprising a binder soluble in aqueous alkali or alcohol solutions, a large amount of an oxadiazole organic photoconductor and a small amount of a sensitizing dye is coated on an aluminum plate. In this case, however, since oxadiazole photoconductor is contained in a large amount, dissolution of the photoconductive layer is not necessarily satisfactory, the oxadiazole organic photoconductor is often precipitated and sensitivity is low. In order to improve these defects, there have been proposed printing plates the photoconductive layer of which comprises two layers, a charge generation layer and a charge transport layer to improve sensitivity by reducing the content of the organic photoconductor, but these printing plates have two-layer construction and hence the cost for production increases.

Furthermore, there are proposed printing plates the photoconductive layer of which comprises a dispersion of various organic photoconductive pigments as the organic photoconductor in a binder soluble in aqueous alkali or alcohol solutions.

For example, in the case of a printing plate comprising an aluminum plate on which is provided a photoconductive layer comprising a dispersion of phthalocyanine pigment in phenolic resin, a sharp increase in sensitivity cannot be expected and hence photoconductors such as said oxadiazole type, pyrazoline type and hydrazone type photoconductors are added, resulting in a reduction of charge potential, precipitation of the photoconductor and deterioration in dissolution. Further, Japanese Patent Unexamined Publication (Kokai) No. "146135/81" uses a printing plate having a light sensitive layer containing condensed polycyclic quinone pigment and an oxadiazole derivative as the organic photoconductor, but this plate is still insufficient in sensitivity and besides, there is the possibility of the precipitation of oxadiazole.

BRIEF EXPLANATION OF THE DRAWING

FIG. 1 shows the graphs prepared by plotting decay of surface potential $V_S$ after exposure on logarithm of exposure. Curve (A) shows characteristics of Example 1 and Curves (B) and (C) show those of Comparative Examples 1 and 2, respectively.

SUMMARY OF THE INVENTION

The object of the present invention is to provide a printing plate which is improved in the above mentioned defects and is high in sensitivity and ease of, dissolving out the non-image area, requires less printing stain and is high in printing endurance.

DESCRIPTION OF THE INVENTION

The above object is attained by an electrophotographic plate for lithographic printing comprising an electrically conductive and hydrophilic base and, provided thereon, a photoconductive layer from which a lithographic printing plate is made by forming toner images and dissolving out the non-image area other than the toner image portions with a solution mainly composed of an alkali and/or alcohol, characterized in that said photoconductive layer contains an alkali and/or alcohol soluble polymer, a phthalocyanine pigment and a compound represented by the formula (I):

$$(X)_nY \qquad (I)$$

(wherein X represents a thiobarbituric acid residue from which one hydrogen atom at the 5-position is eliminated and in which a nitrogen atom in the ring may have a substituent; Y represents an n-valent substituted or unsubstituted alkylene or aralkylene residue; and n is an integer of 2 to 4).

That is, the first component in the photoconductive layer of the electrophotographic plate for lithographic printing of the present invention is a polymer soluble in alkali and/or alcohol. As examples of the polymer, mention may be made of, for example, phenolic resin, alcohol-soluble nylon resin, styrene-maleic anhydride copolymer, vinyl acetatecrotonic acid copolymer, vinyl acetate-maleic anhydride copolymer, bi- or terpolymers of acrylic acid, methacrylic acid, crotonic acid or itaconic acid and styrene, acrylic ester or methacrylic ester.

These polymers may be used alone or in an admixture of two or more and act as a binder. If necessary, other insoluble polymers or insoluble polymer particles, silica fine particles and the like for surface roughening may be added in a small amount.

Taking a polymer having the carboxyl group as a soluble group as one example the number of carboxyl groups may be optionally changed in correlation with the solubility of the solution for dissolving out the non-image area, namely, the number of carboxylic acid residues of the monomer containing the carboxyl group, the hydrophobic property of the monomer containing no carboxyl group and the molecular weight of the polymer, and the dissolvability of the solution for the non-image area. Polymers of about 10–300 in terms of acid value may be used.

In the present invention, vinyl acetate based polymers and acrylic polymers are most preferred among the above polymers considering their ability to dissolve the non-image area and its non dissolution the toner image.

The second component of the photoconductive layer of the present invention is an organic photoconductive material. Many materials are known as organic photoconductive materials, but in the present invention, phthalocyanine pigments are used in combination with sensitizers explained hereafter.

There are many kinds of phthalocyanine pigments which are different in their crystal system and the presence or absence of metals. With reference to crystal system, there are $\alpha$ type, $\beta$ type, $\gamma$ type, $\delta$ type, $\epsilon$ type, $\rho$ type, $\tau$ type, x type, etc. Almost all metals can coordinate with central atoms and representatives are metal phthalocyanines such as manganese, iron, nickel, cobalt, aluminum, copper, titanium, and platinum phthalocyanines. All phthalocyanine pigments including combined ones, chlorinated ones and metal-free ones have different absorbing wavelengths and are selected depending on their intended use. Among them $\beta$ type copper phthalocyanine is most stable and is manufactured in large amounts as blue coloring pigment.

As phthalocyanine pigments for electrophotography, special ones are used as PPC photoconductors for semiconductor lasers of approximately 800 nm. Because of the high speed of exposure, phthalocyanine pigments used for these PPC photoconductors can be used if they possess high photosensitivity even if they are somewhat low in retention of dark decay.

In the present invention, phthalocyanine pigments high in retention of dark decay are required especially as photoconductors exposed by laser scanning. Among the phthalocyanines enumerated above, $\epsilon$ type copper phthalocyanine is highest in retention of dark decay and provides high contrast and thus is preferred for use in the printing plates of the present invention.

The $\epsilon$ type copper phthalocyanine can be easily synthesized by the method disclosed in Japanese Patent Examined Publication (Kokoku) No. 2780/65.

The mixing ratio (% by weight) of phthalocyanine pigment used in the present invention per said alkali and/or alcohol-soluble polymer is suitably 30% by weight or less considering its practical dissolving-out property. Said phthalocyanines as such have considerable photosensitivity, but in the case of said mixing ratio, they are therefore low in photosensitivity and are poor in practicality. When they are mixed in an amount of 50–80% by weight, photosensitivity is enhanced, but retention of potential and retention of dark decay decreases. In addition, with an increase in the proportion of pigment, the dissolving-out property deteriorates and the resulting printing plates cannot be put to practical use.

The third component of the photoconductive layer in the present invention is a sensitizer to increase the photoconductivity of the photoconductive layer comprising said polymer and phthalocyanine pigment. As the sensitizer, a compound represented by the following general formula (I) is used.

$$(X)_nY \qquad \text{(I)}$$

wherein X is a thiobarbituric acid residue wherein one hydrogen atom at the 5-position has been eliminated and a nitrogen atom in the ring thereof may have a substituent such as an alkyl group (for example, methyl, ethyl, isopropyl, butyl, isobutyl, octyl, ethylhexyl, dodecyl and octadecyl), an aryl group (for example, phenyl, tolyl, methoxyphenyl and chlorophenyl), an aralkyl group (for example, benzyl), a heterocyclic group (for example, pyridyl), a cycloalkyl group (for example, cyclohexyl and an cyclobenzyl) and allyl; Y is an n-valent substituted or unsubstituted alkylene residue (for example, methylene, butylidene, benzylidene, propylidene and pentananediylidene) or an aralkylene (for example, xylenediylidene); and n is an integer of 2 to 4.

Nonlimiting examples of the compound represented by the general formula (I) are shown below.

(I)

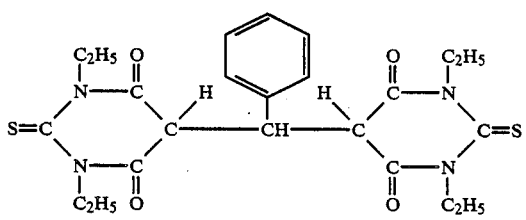

(II)

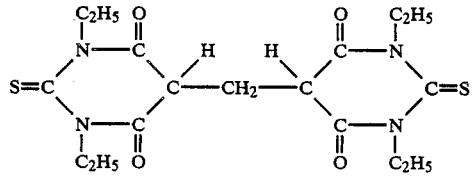

(III)

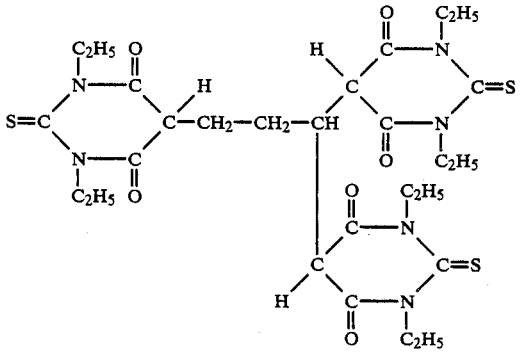

(IV)

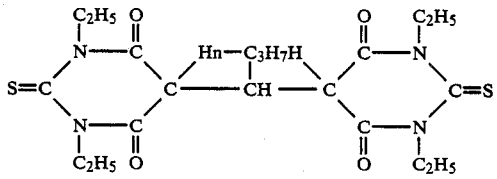

-continued
(V)
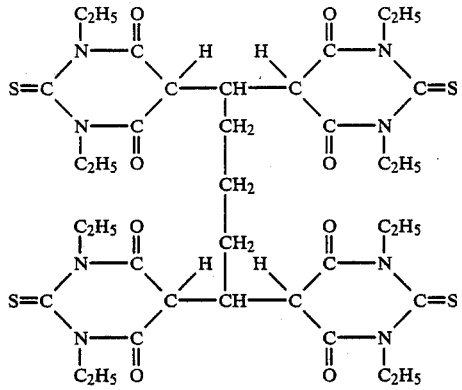
(VI)
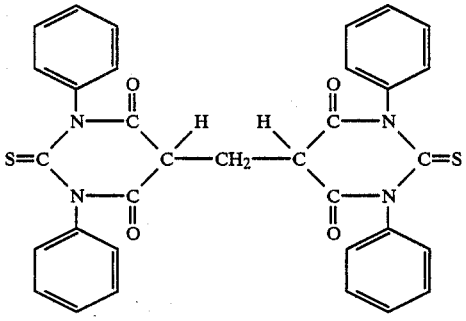
(VII)
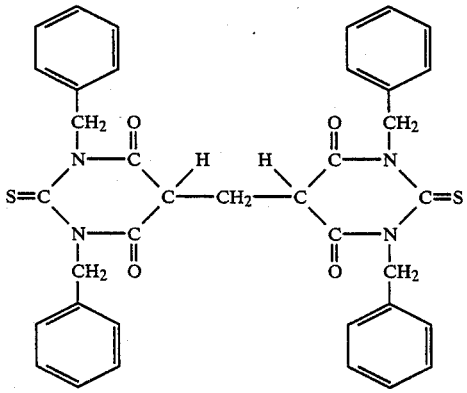
(VIII)
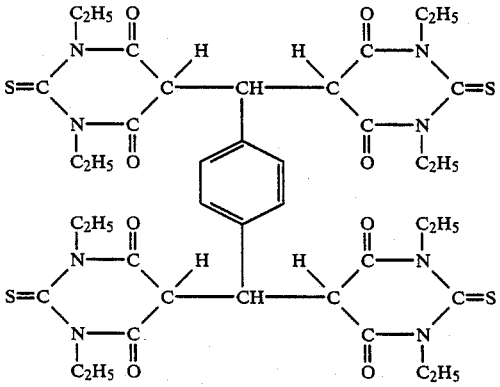
-continued
(IX)
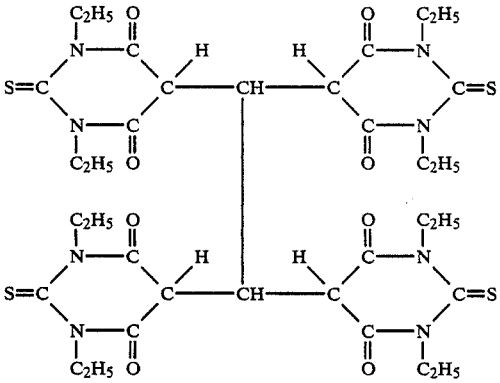
(X)
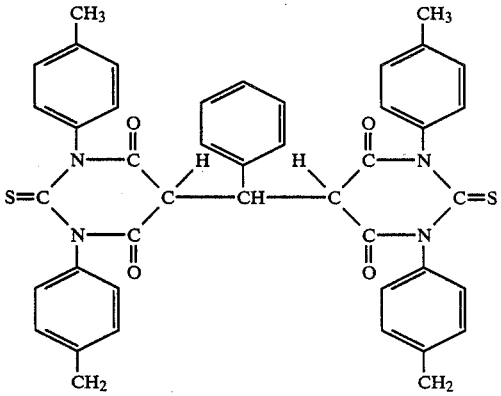
(XI)
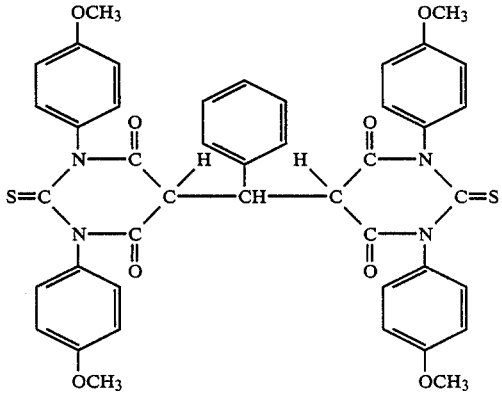
(XII)
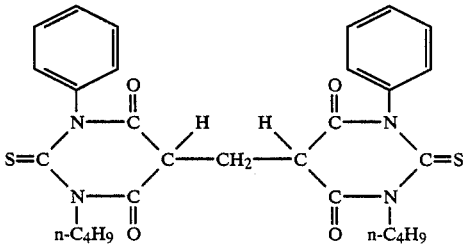
(XIII)
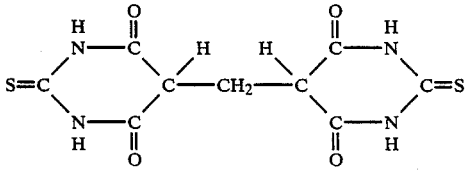

-continued (XIV)

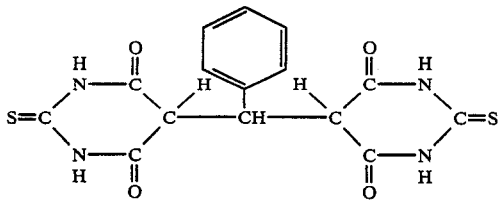

(XV)

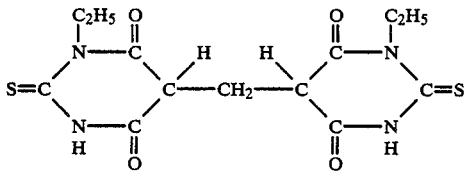

(XVI)

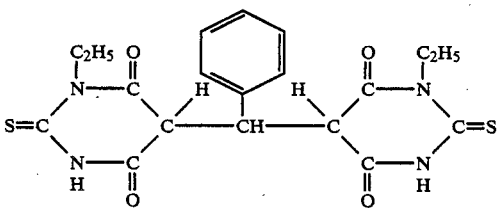

(XVII)

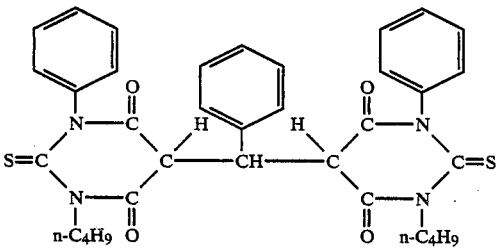

These compounds may be easily synthesized by the method disclosed in Japanese Patent Unexamined Publication (Kokai) No. 99440/79.

Methods for sensitization of photoconductive layers for electrophotography include spectral sensitization and chemical sensitization. As spectral sensitizers, there are known various basic dyes, for example, triphenylmethane dyes, xanthene dyes, thiazine dyes, acridine dyes, cyanine dyes and pyrylium salt dyes such as Ethyl Violet, Rhodamine B, Methylene Blue and Acridine Yellow and the like. However, for printing plates which use polymers containing, for example, carboxyl groups in large numbers, the effect of these dyes are reduced and none of them show a sensitizing effect on the phthalocyanine pigments.

Further, as chemical sensitizers, there are known quinones such as 1-nitroquinone, chloranil, bromanil and 2,5-dichloro-para-benzoquinone, organic acids such as benzoic acid and cinnamic acid and phenols such as p-chlorophenol and m-nitrophenol. However, when polymers containing carboxyl group in large numbers are used, the polymers per se have a chemical sensitizing effect and addition of said chemical sensitizers results in only a small effect. Trinitrofluorenone provides some effect, but cannot be used for printing plates due to its toxicity. Thus, as explained above, an organic photoconductor which is transparent in the visible light range is added as a charge transport agent in a large amount and a phthalocyanine pigment is used as a spectral sensitizer,; but there are various defects with this mentioned previously, and additionally the electrophotographic characteristic of the photoconductive layer becomes markedly low in contrast.

The compound of the general formula (I) is a chemical sensitizer which markedly increases photosensitivity without damaging the electrophotographic characteristic of high contrast provided by the phthalocyanine. Japanese Patent Unexamined Publication (Kokai) No. 99440/79 does not disclose these effects on pigment type organic photoconductors and the effects of the present invention are unexpected. Differences in electrophotographic characteristics are shown in FIG. 1, from which the effects of the present invention are clear.

When said charge transport agent is further added to the photoconductive layer in the present invention, addition thereof in a small amount gives no effect while when added in a large amount, contrast decreases as in the case of adding no chemical sensitizer of the general formula (I) used in the present invention, although sensitivity can be further increased.

Electrophotographic lithographic printing plates high in contrast and sensitivity and excellent in dissolving-out property are provided by specific combination of a polymer having an alkali and/or alcohol soluble group which is the first component of the present invention, a phthalocyanine which is the second component and a compound represented by the general formula (I) which is the third component.

Use of thiobarbituric acid derivatives as a spectral sensitizer is disclosed in Japanese Patent Unexamined Publication (Kokai) Nos. 149462/81, 29050/82 and 119355/82, but they have substantially no effect on the photoconductive layer containing phthalocyanines as in the present invention and only so-called dimers, trimers and tetramers of thiobarbituric acid as represented by the general formula (I) exhibit remarkable effects.

Addition of the compound of general formula (I) is not critical, but suitably is 1–20% by weight of the phthalocyanine pigment.

The printing plate of the present invention is made by subjecting the electrophotographic plate comprising a conductive and hydrophilic base having thereon a photoconductive layer containing at least the above mentioned three components to toner development by electrophotographic process to form images and by removing non-image portions other than the toner images by the dissolving-out method.

As the base for the printing plates, there may be used all of the known bases for printing plates. As examples thereof, mention may be made of metallic plates such as aluminum plate, zinc plate, magnesium plate and copper plate, films or synthetic papers made of polyester, cellulose acetate, polystyrene, polycarbonate, polyamide and polypropylene and coated papers such as resin-coated papers. Since photoconductive compounds and binders are removed by etching treatment after the formation of images and non-image portions must have hydrophilic properties, bases having hydrophilic surfaces must be subjected to hydrophilic treatment prior to use. A metallic plate, especially an aluminum plate is most suitable, but it is preferably subjected to surface treatments such as sandblasting, alkali treatment, acid treatment and anodizing treatment. For films, it is preferred that a relatively highly hydrophilic high molecular compound is coated thereon and subjected to cross-linking treatment or that metal is vapor deposited or laminated thereon. When an insulating base is used, preferably the surface is subjected to conduction treatment.

The electrophotographic plate for making the printing plate according to the present invention is produced by adding the above mentioned three components in a solvent, dispersing them by a suitable known dispersing machine such as a sand mill, colloid mill, homogenizer or ultrasonic dispersing machine to prepare a applying composition, coating this coating composition to said support at a thickness of 1–10 μ and drying the coating. The coating application can be carried out by various known coating methods such as dip coating, bead coating, wire bar coating, blade coating, roller coating, curtain coating and extrusion coating.

The solvents include all organic solvents which can dissolve binders and which can dissolve or disperse the photoconductive compound.

As examples of the solvents, mention may be made of alcohols such as methanol, ethanol, propanol, butanol and hexyl alcohol, cellosolves such as methyl cellosolve, ethyl cellosolve and butyl cellosolve, aromatics such as benzene, toluene and xylene, cyclic ethers such as dioxane and tetrahydrofuran, esters such as ethyl acetate, butyl acetate, amyl acetate, ketones such as acetone, methylisobutyl ketone and methyl ethyl ketone, dimethyl formamide, dimethyl sulfoxide and halogenated hydrocarbons. In many cases, two or more solvents are used in combination for purposes of solubility, cost and safety.

The compound represented by the general formula (I) which is the third component in the present invention is added in a small amount and preferably for ensuring the effect of the compound, it is previously dissolved in a suitable solvent, e.g., methanol, ethanol, toluene, dimethylformamide or dichloromethane and then is added as a solution.

An image is formed on the electrophotographic plate and the non-image portion is dissolved out to produce a printing plate.

Toners used for the image formation include both the so-called dry type and wet type toners, but the wet type toner used for liquid developing is especially preferred in order to obtain prints of superior resolving power. Moreover, because of being used as printing plate, toner is required to be hydrophobic, ink receptive, have adhesion high enough to withstand printing, and further it must resist against the dissolving-out of the non-image portion with alkali and/or alcohol. As toners which satisfy these requirements, mention may be made of, for example, dry type toners such as mixtures of iron powder with fine powder of styrene resin, acrylic resin, polyester resin, epoxy resin and vinyl acetate resin and wet type toners such as dispersions of said resins in electrical insulating isoparaffinic solvents or dispersions of fine particles prepared by polymerization in isoparaffinic solvents to which a charge controller is added. To the toners is added a pigment or dye for coloration in such an amount as will give no adverse effect on safety or fixability.

As the dissolving-out solution for dissolving out the non-image portion, there may be used aqueous solutions of inorganic or organic alkalis and/or alcohols. As inorganic alkalis, mention may be made of, for example, sodium hydroxide, potassium hydroxide, sodium carbonate, sodium silicate, sodium phosphate, potassium phosphate and ammonia and as organic alkalis, mention may be made of, for example, amino alcohols such as monoethanolamine, diethanolamine and triethanolamine.

As alcohols, mention may be made of, for example, lower alcohols and aromatic alcohols such as methanol, ethanol, propanol and benzyl alcohol, ethylene glycol, diethylene glycol, triethylene glycol, polyethylene glycol and cellosolves.

Dissolvability of the dissolving-out solution is selected depending on the solubility of the photosensitive layer the strength of the resistance property of the toner and design of the solution by considering the dissolving-out speed, resolving power, image reproducibility and running characteristics. In general, a small amount of a surfactant is added to increase the dissolving-out speed. After this dissolving-out treatment, the plate may be subjected to water-washing treatment, treatment with dilute aqueous acid solution or gum-coating treatment within aqueous solution of gum arabic. These treatments provide excellent effects in the prevention of staining in printing and on the increase of reproducibility of printed images.

The following nonlimiting examples explain the present invention in more detail.

EXAMPLE 1

A photoconductive layer composition of the following formulation was prepared and its dispersion was carried out by paint conditioner for 2 hours and the dispersion was filtered through glass beads to obtain a coating composition. This coating composition was coated on a sandblasted and anodized aluminum plate 0.24 mm thick by a wire bar 0.5 mmϕ and dried to obtain an electrophotographic plate for printing. The coating of the photoconductive layer was 5.0 g/m$^2$.

| Coating composition for photoconductive layer | |
|---|---|
| ε-copper phthalocyanine (RIOPHOTON ERPC of Toyo Ink Co., Ltd.) | 4.0 g |
| 5,5'-Benzylidene bis-(1,3-diethyl-2-thiobarbituric acid) [Compound (I) exemplified above] | 0.2 g |
| Butyl methacrylate-methacrylic acid copolymer [Molar ratio of monomers: 70:30; acid value: 162] | 20 g |
| Dioxane | 50 g |
| Methyl cellosolve | 120 g |

The electrophotographic characteristics of the thus obtained electrophotographic plate (1) were measured by and electrostatic field measuring device SP428 manufactured by Kawaguchi Denki Co. under the following conditions: +6.0 KV of corona applied voltage and 10 lux of tungsten light. The results were as follows: $V_0$ (initial potential) 380 V: $DD_{10}$ 94%; $E_{\frac{1}{2}}$(exposure for one-half decay) 6.3 lux.sec; $E_{30}$ (exposure required for reduction of surface potential to 30 V) 13 lux.sec. Relation between the exposure and surface potential is shown by curve (A) of FIG. 1, which indicates very high contrast and excellent sensitivity.

For comparison, an electrophotographic plate which did not contain Compound (I) (Comparative Example 1) was prepared in the same manner as above and its electrophotographic characteristics were measured to obtain the following results; $V_0$: 390 V, $DD_{10}$: 95%, $E_{\frac{1}{2}}$: 26 lux.sec and $E_{30}$: 60 lux.sec. In addition, an electrophotographic plate (Comparative Example 2) was prepared with using 10 g of a pyrazoline type organic photoconductor 1-phenyl-3,5-p-diethyl-aminophenyl pyrazoline in place of Compound (I) and its electrophotographic characteristics were measured to obtain the following results; $V_0$: 290 V, $DD_{10}$: 85%, $E_{\frac{1}{2}}$: 12 lux.sec, $E_{30}$: 42 lux.sec. Electrophotographic characteristics of Comparative Examples 1 and 2 are shown by curve (B) and curve (C) in FIG. 1. From FIG. 1, it will be recognized that the electrophotographic plate of Example 1 according to the present invention is higher in sensitivity than those of Comparative Examples 1 and 2 and much higher in contrast than that of Comparative Example 2.

Then, the electrophotographic plate (1) of the present invention was set in a commercially available plate making machine of electrophotographic type and subjected to development with toner and non-image portions were dissolved out with an 8-fold diluted aqueous solution of DP-4 (aqueous alkali solution manufactured by Fuji Photo Film Co., Ltd.). Then, the plate was washed with water and gum was applied to obtain a lithographic printing plate.

In the same manner, a printing plate was made from the electrophotographic plate of Comparative Example 2 and was compared with the present printing plate on a number of steps of wedge image to find that in the printing plate of the present invention, half tone portion comprises two steps while 6 steps are seen in the printing plate of Comparative Example 2 and thus, the former is higher in contrast.

The printing plate of the present invention was mounted on a rotary press of form OFFcon 204RR (manufactured by Ukita Kogyo Co.) and printing was performed. 100,000 copies could by printed without any printing stains. Thereafter, the plate was examined to find no wearing-off on the surface and further printing was possible.

Examples 2–10

In the same manner as in Example 1, except that the nine compounds shown in Table 1 were respectively used in place of Compound (I), coating was conducted by a wire bar of 0.4 mmϕ and dried to obtain electrophotographic plate with a 4.5 g/m$^2$ of photoconductive layer. Electrophotographic properties thereof are shown in Table 1. For comparison, an electrophotographic plate containing TBA(1,3-diethyl-2-thiobarbituric acid) was prepared. (Comparative Example 3).

TABLE 1

| | Compound (No.) | Electrophotographic characteristics: Initial potential $V_0$ (Volts) | Retention of dark decay $D.D_{10}$ (%) | Exposure for one-half decay $E_{\frac{1}{2}}$ (lux · sec) | $V_S$: 30V exposure $E_{30}$ (lux · sec) |
|---|---|---|---|---|---|
| Example 2 | II | 320 | 96 | 6.0 | 8.5 |
| Example 3 | III | 300 | 92 | 8.2 | 12 |
| Example 4 | IV | 290 | 95 | 5.0 | 7.5 |
| Example 5 | V | 310 | 92 | 7.5 | 10 |
| Example 6 | VII | 320 | 96 | 6.0 | 9.0 |
| Example 7 | XII | 310 | 95 | 6.0 | 8.5 |
| Example 8 | XIII | 320 | 96 | 5.0 | 7.5 |
| Example 9 | XIV | 310 | 96 | 5.0 | 7.0 |
| Example 10 | XV | 320 | 96 | 6.0 | 8.5 |
| Comparative Example 3 | TBA | 320 | 89 | 20 | 35 |

As in Example 1, according to the plates of the present invention, sensitivity was sharply increased without damaging retention of dark decay and high contrast of ϵ-copper phthalocyanine.

Printing plates were made from them and printing was conducted in the same manner as in Example 1 to obtain prints which were sharp in image; printing endurance of the plates was also superior.

What is claimed is:

1. An electrophotographic plate for making a printing plate therefrom which comprises an electrically conductive and hydrophilic base and a photoconductive layer provided thereon, said photoconductive layer containing an alkali and/or alcohol soluble polymer, a phthalocyanine pigment and a compound represented by the formula (I):

$$(X)_nY \qquad \text{(I)}$$

wherein X represents thiobarbituric acid residue from which one hydrogen atom at the 5-position has been eliminated and in which a nitrogen atom in a ring may have a substituent; Y represents an n-valent substituted or unsubstituted alkylene or aralkylene residue; and n represents an integer of 2 to 4.

2. An electrophotographic plate according to claim 1 wherein the polymer is a vinyl acetate based polymer or an acrylic polymer.

3. An electrophotographic plate according to claim 1 wherein the phthalocyanine pigment is ϵ-copper phthalocyanine.

4. An electrophotographic plate according to claim 1 wherein the compound represented by the formula (I) is selected from the following group:

(I)

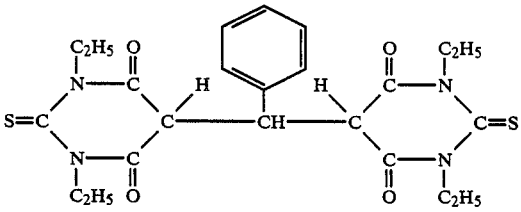

(II)

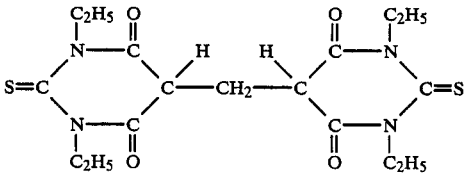

-continued
(III)
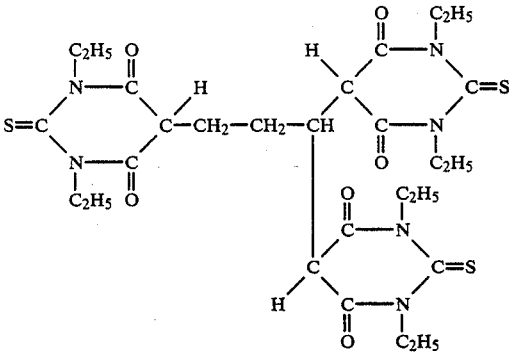
(IV)
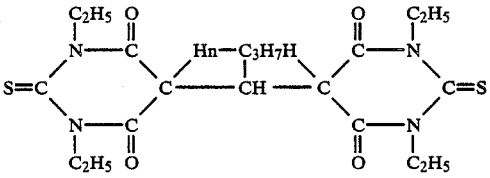
(V)
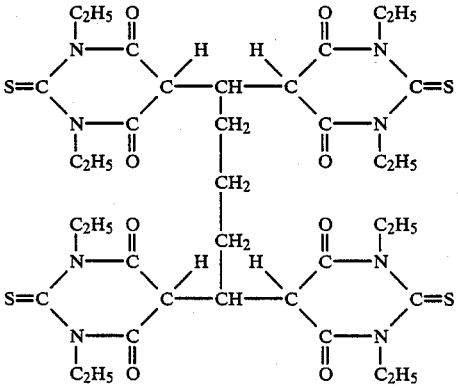
(VI)
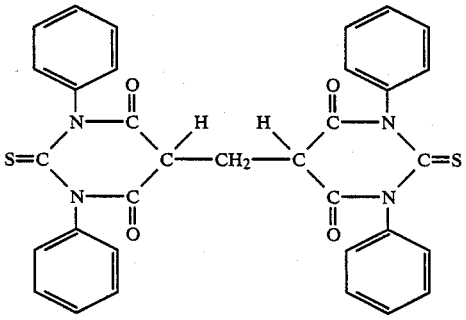
(VII)
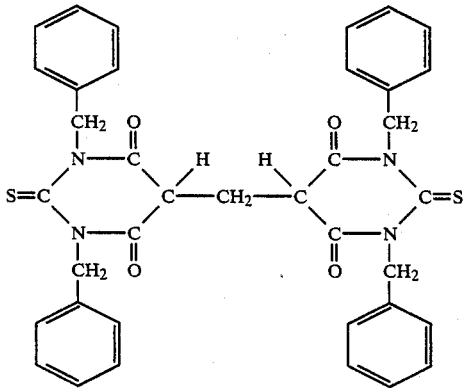
-continued
(VIII)
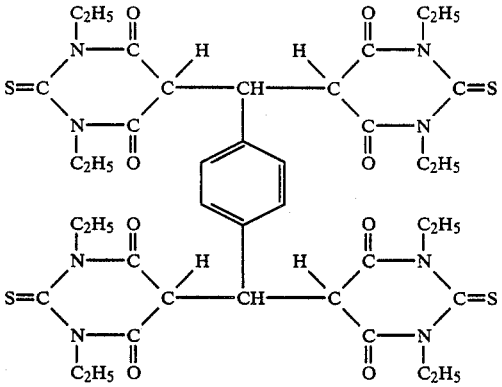
(IX)
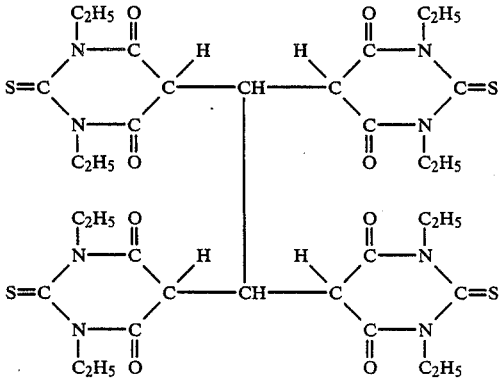
(X)
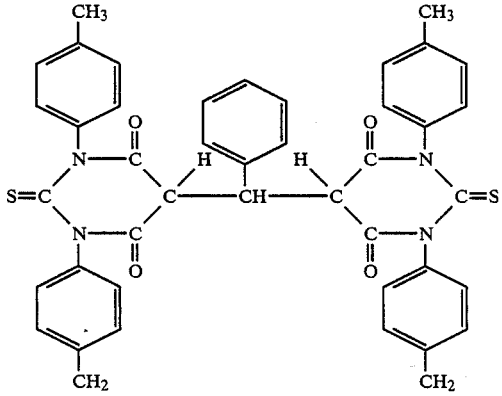
(XI)
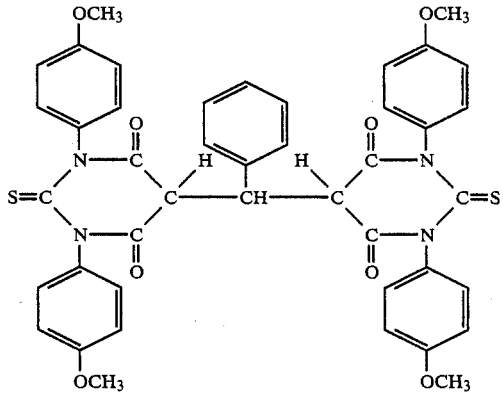

-continued (XII)

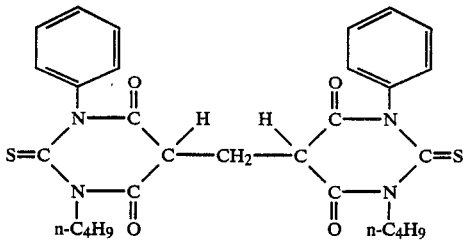

(XIII)

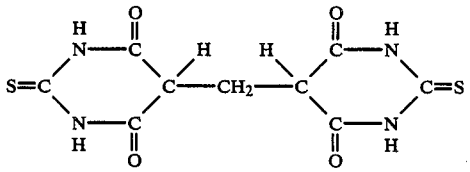

(XIV)

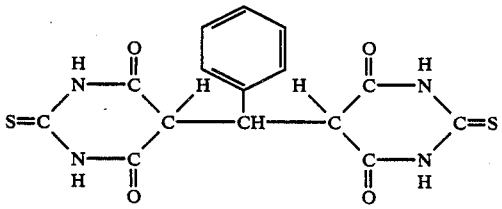

(XV)

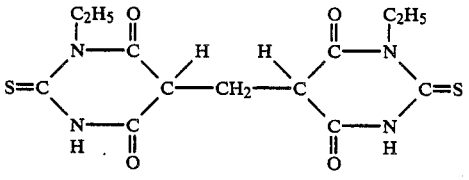

(XVI)

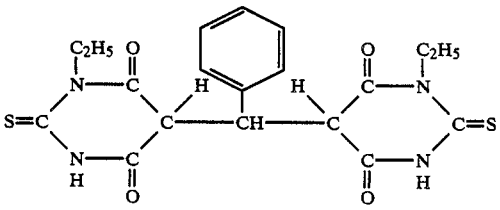

-continued (XVII)

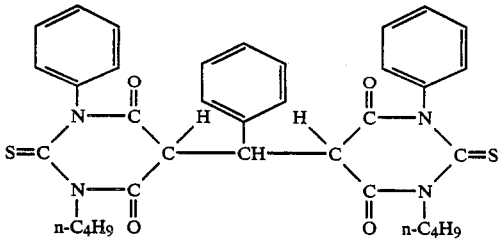

5. An electrophotographic plate according to claim 1 wherein the content of the compound represented by the formula (I) is 1–20% by weight of the phthalocyanine pigment.

6. A method for making a printing plate from the electrophotographic plate of claim 1 which comprises imagewise exposing the electrophotographic plate, subjecting the exposed plate to development with toner to form an image and then dissolving out the non-image portion with a solution.

7. A method according to claim 6 wherein the solution for dissolving out the non-image portion of the photoconductive layer is an aqueous solution of an inorganic or organic alkali and/or alcohol.

8. A printing plate made by the method of claim 6.

9. A method of printing which comprises mounting the printing plate of claim 8 and carrying out printing.

10. An electrophotographic plate according to claim 1 wherein the content of the phthalocyanine pigment is 30% or less by weight based on the weight of the polymer.

11. An electrophotographic plate according to claim 10 wherein the content of the compound represented by the formula (I) is 1–20% by weight of the phthalocyanine pigment.

12. A method for making a printing plate from the electrophotographic plate of claim 10 which comprises imagewise exposing the electrophotographic plate, subjecting the exposed plate to development with toner to form an image and then dissolving out the non-image portion with a solution.

13. A method according to claim 12 wherein the content of the compound represented by the formula (I) is 1–20% by weight of the phthalocyanine pigment.

* * * * *